US009889958B2

(12) United States Patent
Roefs

(10) Patent No.: US 9,889,958 B2
(45) Date of Patent: Feb. 13, 2018

(54) TOOL AND METHOD FOR OPENING A VACUUM SEALED BOTTLE

(71) Applicant: Paul H. Roefs, Whittier, CA (US)

(72) Inventor: Paul H. Roefs, Whittier, CA (US)

( * ) Notice: Subject to any disclaimer, the term of this patent is extended or adjusted under 35 U.S.C. 154(b) by 0 days.

(21) Appl. No.: 14/598,481

(22) Filed: Jan. 16, 2015

(65) Prior Publication Data

US 2015/0121816 A1 May 7, 2015

Related U.S. Application Data

(63) Continuation-in-part of application No. 10/931,692, filed on Aug. 31, 2004, now abandoned.

(51) Int. Cl.

| | |
|---|---|
| ***B65B 43/40*** | (2006.01) |
| ***B65B 7/28*** | (2006.01) |
| ***B26F 1/32*** | (2006.01) |
| ***B67B 7/20*** | (2006.01) |
| ***B67B 7/00*** | (2006.01) |

(52) U.S. Cl.

CPC ..... *B65B 43/40* (2013.01); *B26F 1/32* (2013.01); *B65B 7/2864* (2013.01); *B67B 7/20* (2013.01); *B67B 7/24* (2013.01)

(58) Field of Classification Search

CPC ..... B26F 1/00; B26F 1/24; B26F 1/32; B26F 1/34; B65B 43/40; B65B 7/2864; B65B 7/20; B65B 7/24

USPC ..... 30/358, 366, 123.5, 123.7, 443

See application file for complete search history.

(56) References Cited

U.S. PATENT DOCUMENTS

| | | | | | |
|---|---|---|---|---|---|
| 1,465,793 | A * | 8/1923 | Schilling | B67B 7/26 | 222/90 |
| 1,689,047 | A * | 10/1928 | Packer | B67B 7/24 | 30/366 |
| 2,187,394 | A * | 1/1940 | Glocker | B65D 45/28 | 174/17 CT |
| 2,390,309 | A * | 12/1945 | Keys | B67B 7/24 | 30/151 |
| 3,074,160 | A * | 1/1963 | Burns | B67B 7/24 | 30/415 |
| 3,607,103 | A * | 9/1971 | Kiefer | B65D 83/00 | 206/0.5 |
| 3,797,112 | A * | 3/1974 | Paulson | B67B 7/24 | 285/13 |
| 5,657,676 | A * | 8/1997 | Koller | B09B 3/0058 | 137/318 |
| 6,749,097 | B1 * | 6/2004 | McElhinny | B26D 7/22 | 225/20 |
| 8,387,264 | B1 * | 3/2013 | Pritchard | B26F 1/32 | 30/315 |

(Continued)

*Primary Examiner* — Phong Nguyen

(74) *Attorney, Agent, or Firm* — Averill & Green; Kenneth L. Green

(57) ABSTRACT

A tool and method for puncturing a lid of a vacuum sealed bottle to release the vacuum and allow easy opening. A point extends down from the tool, and force may be exerted against the tool by the palm or thumb of a user causing the point to penetrate the lid. The point preferably extends between 3/16 inches and 1/16 inches down from the handle, and more preferably about 3/16 inches. In some embodiments the tool is mushroom shaped having a wider round or oval upper portion for grasping and a narrower lower portion centered under the upper portion of the handle, the point extending down from the lower portion.

17 Claims, 3 Drawing Sheets

(56) References Cited

U.S. PATENT DOCUMENTS

2011/0108599 A1* 5/2011 Nottingham ..... B65H 35/002
225/77

* cited by examiner

TOOL AND METHOD FOR OPENING A VACUUM SEALED BOTTLE

CROSS-REFERENCE TO RELATED APPLICATIONS

The present application is a Continuation In Part of U.S. patent application Ser. No. 10/931,692 filed Aug. 31, 2004, which application is incorporated in its entirety herein by reference.

BACKGROUND OF THE INVENTION

The present invention relates to kitchen utensils, and specifically to tools for puncturing a lid of a vacuum sealed bottle to release the vacuum seal to allow easy removal of the lid.

To avoid contamination and prevent tampering, many food and beverage, and medicine bottles available in the marketplace are equipped with vacuumed sealed lids, wherein the food or liquid is placed in the bottle while hot and allowed to cool after the lid is screwed or pressed onto the bottle to securely seal the bottle. The resultant vacuum forces are often quite large and require a disengagement force that is difficult to generate by normal human hand and wrist action. Even a hardy person must sometimes resort to extraordinary effort to remove the lid. The difficulty is exacerbated for the elderly and/or physically challenged.

A number of tools have been offered or suggested to aid in removing such lids, to remove other strongly secured lids, such as paint can lids, or to otherwise open sealed bottles. Lid wrenches and other tools to provide mechanical leverage to help turn a lid against the force of a vacuum seal are illustrated by U.S. Pat. No. 3,724,296 (Graver), U.S. Pat. No. 5,083,482 (Floyd), U.S. Pat. No. 6,105,468 (Fohrman et al.), D440,842 (Vandergaw), and U.S. Pat. No. 6,490,951 (Davidson). Such tools, while providing leverage still require substantial strength to use and are large and relatively expensive. Tools that have been designed for prying open paint cans and the like, and to also punch a hole in the paint can gutter to enable paint to drain back into the can, are illustrated by U.S. Pat. No. 4,580,302 (Barth), U.S. Pat. No. 5,127,121 (Bossie), U.S. Pat. No. 5,568,665 (Fick), and U.S. Pat. No. 6,360,444 (Fluhr et al.). Such tools take advantage of a space between the edge of the paint can and the lid, where a gutter is formed, and are not useful for removing vacuum sealed lids, which generally do not have such a pry edge. Tools that have been designed to puncture can tops or to facilitate or replace the use of built-in tab openers are illustrated by U.S. Pat. No. 4,357,753 (Wilkinson), U.S. Pat. No. 4,136,448 (Fournier et al.), U.S. Pat. No. 4,549,451 (Widman), U.S. Pat. No. 5,203,087 (Richard), and U.S. Pat. No. 5,644,848 (Totten). Such tools are large and relatively expensive, are not readily applied to vacuum sealed jar lids or the like. Moreover, the holes punched into the can tops are generally too large to be easily resealed if that is desired by the consumer. U.S. Pat. No. 5,150,802 (Jeffers) describes a puncture and seal apparatus that can be secured to a bottle, which straddles the bottle, a presser plate pushing the bottom of the can onto a piercing cone which creates a pierced opening and then seals the opening for subsequent use as a spout that can be opened and closed. Aside from its relatively high cost and great size, the tool is not useful to open vacuum sealed lids on jars and the like. Finally, of superficial relevance to the structure of the present invention, is a golf tee awl for making holes in the ground, to make it easier to insert golf tees, is disclosed in U.S. Pat. No. 4,090,298 (Rushforth). There is no suggestion that such a tool could be used to release the vacuum of sealed jar lids and the like, nor could the elongate spike of that tool be easily used for that purpose.

BRIEF SUMMARY OF THE INVENTION

The present invention addresses the above and other needs by providing a tool and method for puncturing a lid of a vacuum sealed bottle to release the vacuum and allow easy opening. A point extends down from the tool, and force may be exerted against the tool by the palm or thumb of a user causing the point to penetrate the lid. The point preferably extends between 3/16 inches and 1/16 inches down from the handle, and more preferably about 3/16 inches. In some embodiments the tool is mushroom shaped having a wider round or oval upper portion for grasping and a narrower lower portion centered under the upper portion of the handle, the point extending down from the lower portion.

In accordance with one aspect of the invention, there is provided a puncturing tool which enables even a weak, disabled or very elderly person to make a tiny puncture through the lid of the bottle, releasing the vacuum to equalize the pressure to atmosphere so that the lid can then be removed with very little effort. If the product is to be reused, it can be placed in a refrigerator, the tiny hole providing little opportunity for spoilage. Alternatively, a small piece of tape, such as Scotch brand cellophane tape or "Magic" tape, or a small amount of wax, can be place over the tiny hole to reestablish the integrity of the lid.

In accordance with another aspect of the invention, there is provided a puncturing tool for puncturing the lid of a vacuum sealed bottle to release the vacuum, having a handle that can be held in the hand of a user and having a palm or thumb contacting top surface against which pressure may be exerted by the palm or thumb of the user. A point extends from the bottom surface of the handle, the point being formed to penetrate the lid when pressure is exerted against the top surface of the handle. The length of the point is such as to extend less than 3/16 inch from the bottom end of the handle, in preferred embodiments, less than 1/8 inch from the handle bottom end, and in still more preferred embodiments, less than 1/16 inch from the handle bottom end.

In accordance with yet another aspect of the invention, there is provided a puncturing tool having a point defined by an axial shank connected at a proximal end to the handle and formed with the point at its distal end, the handle being formed with a hole for receiving the proximal end of the shank secured therein. A layer of compressible material can be disposed on the bottom surface of the handle, the point extending through the compressible material when the compressible material is compressed and extending less than 1/8 inch beyond the layer of compressible material when the compressible material is uncompressed.

In accordance with still another aspect of the invention, there is provided a puncturing tool having a handle formed of an upper portion defining a palm or thumb contacting surface, and an integral bottom portion of substantially cylindrical shape, sized to accommodate a user's index and middle fingers when the user's thumb contacts the top surface of the handle. The handle and point can be formed in one piece of metal, or they can be formed of different material. For example, the point can be formed of stainless steel and the handle formed of a ceramic, other metal, plastic, or of hardwood.

In accordance with another aspect of the invention, there is provided a method for puncturing a lid of a vacuum sealed bottle to allow easy removal of the lid. The method includes the steps of grasping a handle of a lid puncturing tool, holding the tool to position a point extending down from the tool against a lid of a vacuum sealed bottle, pressing the point against the lid with sufficient force to puncture the lid, releasing vacuum from the bottle, removing contents from the bottle, replacing the lid onto the bottle, and placing tape over the puncture in the lid.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
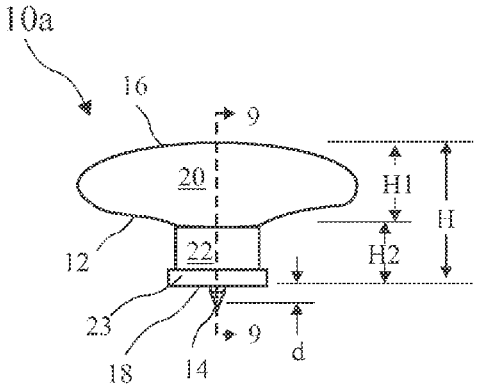
FIG. 1 is a side view of a first embodiment of a tool constructed in accordance with the present invention.

Referring to FIG. 1, one embodiment of a lid puncturing tool 10*a* of the present invention is shown, the tool 10*a* comprises a handle 20 and a point 14. The tool 10*a* has an overall height (not including the point 14) H of about 1.1 inches, the handle 20 has a height H1 of about 0.6 inches, and the handle 20 is a height H2 of about 0.5 inches above the point 14. The handle 20 is configured to be held in the hand of a user and has a smooth circular convex top surface 16 against which pressure may be exerted by the palm, fingers, or thumb of the user, and a smooth rounded bottom surface 12 to facilitate grasping. An integral bottom portion (or spacer) 22 preferably resides below the handle 20. The spacer 22 preferably has a substantially cylindrical shape, and is sized to accommodate a user's index and middle fingers when the user holds the handle 20. A flat disk-like section 23 may reside under the spacer 22 and extends the diameter of the spacer 22 by a small amount.

The point 14 extends down a depth d below the bottom surface 18 of the section 23 and the point 14 is configured to penetrate a vacuum sealed lid when force is exerted against the top surface 16 of the handle 20. The point 14 preferably extends the depth d between 1/16 and 1/4 inches below the bottom surface 18, and more preferably the point extends about 3/16 inch below the bottom surface 18.

Figure 2:
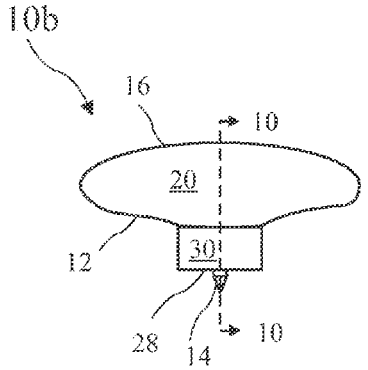
FIG. 2 is a side view of a second embodiment of a tool constructed in accordance with the present invention.

Referring to FIG. 2, another embodiment comprising a tool 10*b* is shown, which is similar to the embodiment of FIG. 1 but does not include the section 23. Accordingly, for ease and consistency of description, when appropriate, the same element numbers will be used in FIG. 2 as used in FIG. 1. The tool 10*b* also comprises a handle 20 and a point 14. The point 14 extends from the bottom surface 28 of a spacer 30 replacing the spacer 22. The point 14 of the tool 10*b* is the same length as the point 14 described above.

Figure 3:
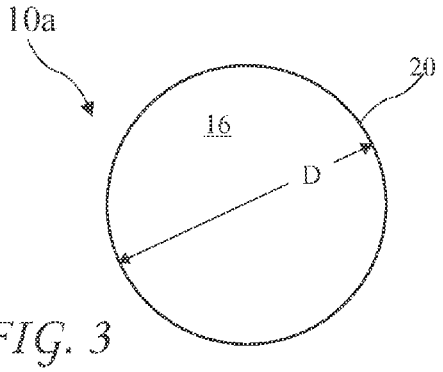
FIG. 3 is a top view of the embodiment of FIG. 1.
Figure 4:
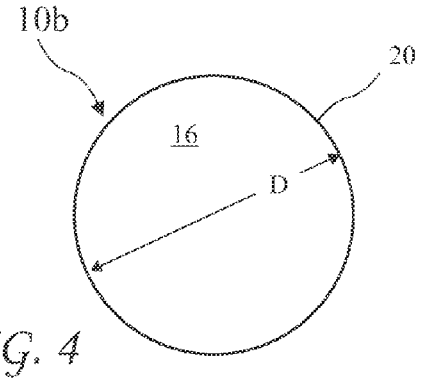
FIG. 4 is a top view of the embodiment of FIG. 2.

FIGS. 3 and 4 show top plan views of the tools 10*a* and 10*b* respectively. The handle 20 has a diameter D. The diameter D is preferably between 1.5 and 2.5 inches, and more preferably between 1.5 and two inches, and most preferably about 1.5 inches. The handle 20 may also be oval of about the same size.

Figure 5:
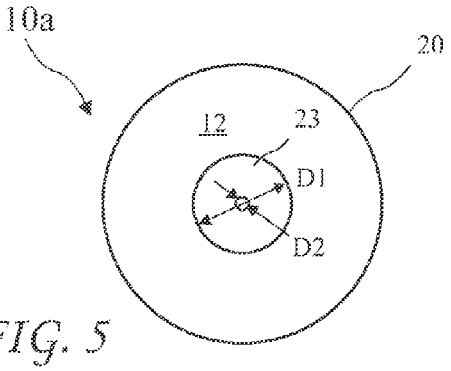
FIG. 5 is a bottom view of the embodiment of FIG. 1.

FIG. 5 shows a bottom view of the tool 10*a*. The section 23 has a diameter D1 of about 0.6 inches and is preferably a little greater than 1/3 the diameter of the handle 20. The point 14 has a diameter D2 of about 0.15 inches.

Figure 6:
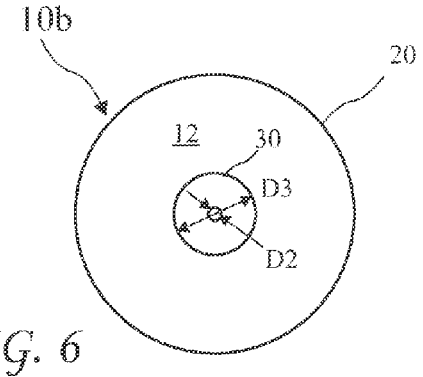
FIG. 6 is a bottom view of the embodiment of FIG. 2.

FIG. 6 shows a bottom view of the tool 10*b*. The spacer 30 has a diameter D3 of about 0.5 inches and is preferably about 1/3 the diameter of the handle 20.

Figure 7:
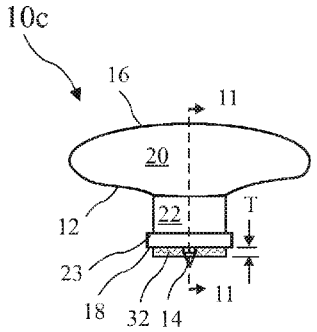
FIG. 7 is a side view of the embodiment of FIG. 1 with a layer of compressible material attached to the bottom of the tool in accordance with the present invention.
Figure 8:
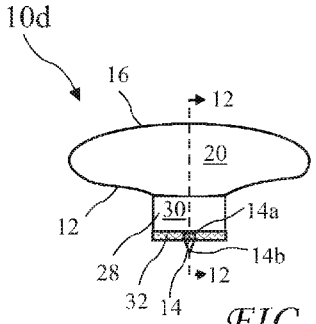
FIG. 8 is a side view of the embodiment of FIG. 2 with the layer of compressible material attached to the bottom of the tool in accordance with the present invention.
Figure 9:
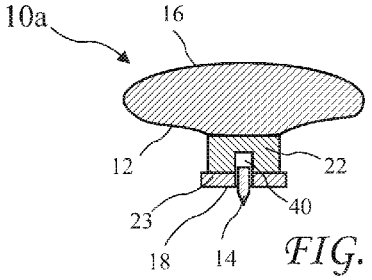
FIG. 9 is a cross-sectional view of the tool taken along line 9-9 of FIG. 1.
Figure 10:
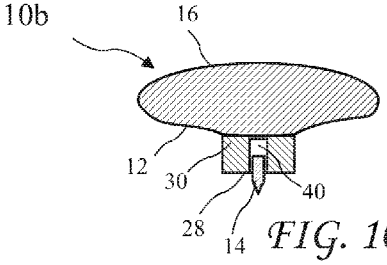
FIG. 10 is a cross-sectional view of the tool taken along line 10-10 of FIG. 2.
Figure 11:
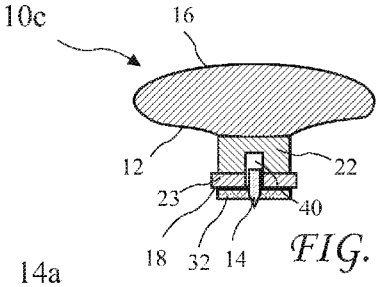
FIG. 11 is a cross-sectional view of the tool taken along line 11-11 of FIG. 7.
Figure 12:
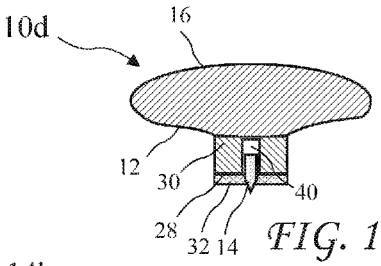
FIG. 12 is a cross-sectional view of the tool taken along line 12-12 of FIG. 8.

Referring to FIGS. 7 and 8, tools 10*c* and 10*d* are shown wherein the respective tools 10*a* and 10*b* are each fitted with a layer 32 of compressible material. The compressible material can be in the form of a rubber or rubber-like washer, or a disk of felt, or a disk of a loop material of a hook and loop material, or similar compressible material. The point 14 extends through the layer 32 about 1/16 inch beyond the layer 32 when the layer 32 is uncompressed, reducing the likelihood of scratching or puncturing the skin of a user, or of kitchen items. The point 14 attached to the handle 20 at 14*a*, and has a tip 14*b* opposite to the handle 20.

Cross-sectional views of the tools 10*a*, 10*b*, 10*c*, and 10*d* taken along lines 9, 10, 11, and 12 of FIGS. 1, 2, 7, and 8 are shown in FIGS. 9, 10, 11, and 12 respectively. The point 14 is defined by an exposed conical portion 15*a* and an attached cylindrical portion 15*b* (see FIG. 13A). The handle 20 is formed with a hole 40 for receiving the cylindrical portion 15*b*, which is secured therein. The hole 40 and shank 36 may include respective mating female and male screw threads so that the shank can be screwed into the handle (and easily replaced if needed).

Figure 13A:
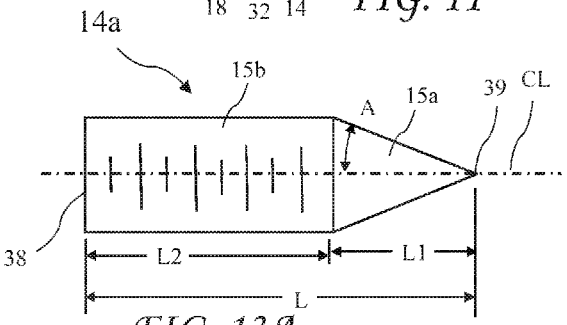
FIG. 13A is a side view of a threaded point in accordance with the present invention.

Details of a point 14*a* are shown in FIG. 13A. The point 14*a* has an overall length L of about 0.5 inch from its base 38 to a tip 39, a length L1 of about 1/8 inches of a conical portion 15*a*, and a length L2 of about 3/8 inches of the cylindrical portion. The conical portion 15*a* forms an angle A of preferably between 20 and 40 degrees and more preferably about 30 degrees from a centerline CL of the point 14. The cylindrical portion 15*b* includes male threads for cooperating with female threads in the hole 40. Using a threaded point 14*a* provides an advantage of being able to adjust the extent of protrusion of the point 14*a* from the handle 20.

Figure 13B:
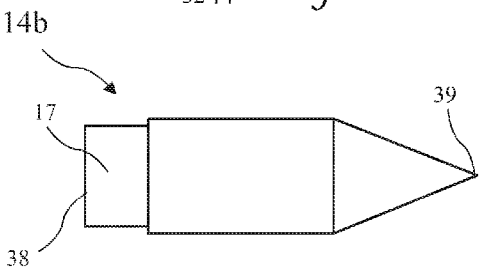
FIG. 13B is a side view of a stepped point in accordance with the present invention.

A second point 14*b* shown in FIG. 13B provides an interference fit with the hole 40. A smaller diameter stepped end 17 allows the point 14 to be easily started in the hole 40, and then mechanically pressed into a final position.

The point 14 may also be secured by use of an adhesive, such as Locktite B (Eastman 9-10), secured by plastic injection molding, or the like. The handle 20 may be formed by plastic injection molding and the point 14 may include a medium knurl for retention.

The handle and shank can be formed of the same or different materials. For example, the handle can be formed of ceramic material, or other material, or both the shank and handle can be formed of stainless steel or other metal. Preferably the handle is formed of a ceramic material, or of hardwood or plastic, and the shank is formed of stainless or other steel, preferably heat-treated. In an alternative embodiment, the handle and point are formed in one piece from plastic or steel, or other metal.

Figure 14A:
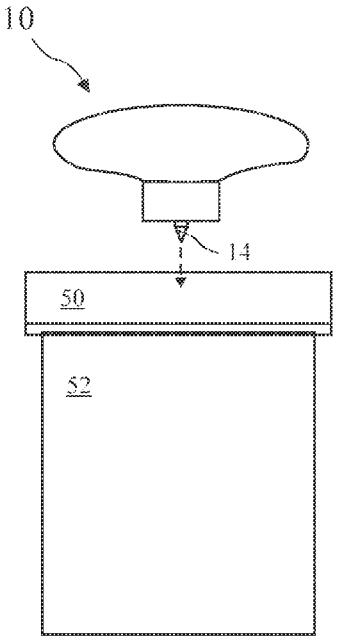
FIG. 14A shows the tool positioned to puncture a vacuum sealed lid of a bottle.
Figure 14B:
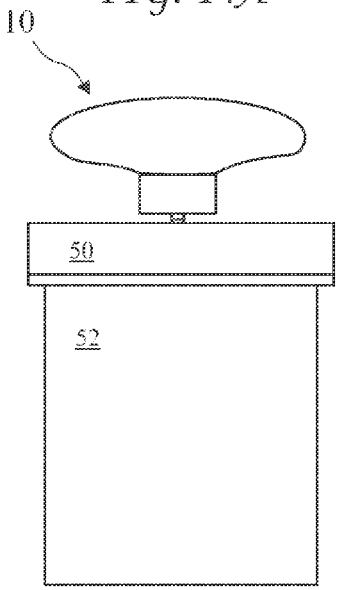
FIG. 14B shows the tool after puncturing a vacuum sealed lid of a bottle.

The tool 10 is shown above a vacuum sealed bottle 52 and lid 50 in FIG. 14A, and after puncturing the lid in FIG. 14B. The length and pitch of the point 14 were selected after significant experimentation to puncture the lid 50 with little effort and to minimally puncture the lid 50 which is sufficient to release pressure vacuum in the bottle 52 allowing easy removal of the lid 50 from the bottle 52. Providing a minimal puncture allows the lid 50 to be reattached and provide a useful sealing of the bottle 52 after initial opening.

Figure 15:
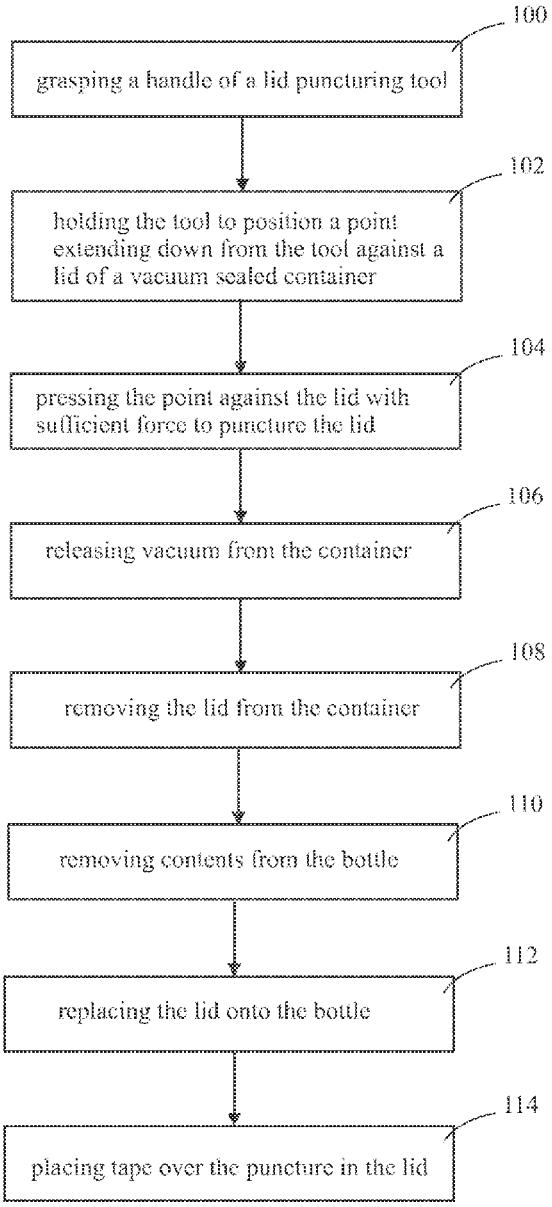
FIG. 15 is a method for opening vacuum sealed bottles according to the present invention.

A method for puncturing a lid of a vacuum sealed bottle to allow easy removal of the lid is shown in FIG. 15. The method includes the steps of grasping a handle of a lid puncturing tool at step 100, holding the tool to position a point extending down from the tool against a lid of a vacuum sealed bottle at step 102, pressing the point against the lid with sufficient force to puncture the lid at step 104, releasing vacuum from the bottle at step 106, removing the lid from the bottle at step 108, removing contents from the bottle at step 110, replacing the lid onto the bottle at step 112, and placing tape over the puncture in the lid at step 114. When the entire contents of the bottle are removed, there is no need to perform steps 112 and 114.

The tool 10 may further find application in scoring fruit skins to facilitate peeling, tearing tamper proof seals to facilitate removal, tearing packaging tape to open packages, perforating frozen food covering before microwave cooking, perforating a canned drink lid to allow the lid to relax to expose a pull tab.

While the invention herein disclosed has been described by means of specific embodiments and applications thereof, numerous modifications and variations could be made thereto by those skilled in the art without departing from the scope of the invention set forth in the claims.

I claim:

1. A method for facilitating opening a sealed article, comprising:

providing a vacuum sealed bottle;

providing a puncturing tool comprising:

a handle having a diameter of about 1.5 inches and a height of about 0.6 inches;

a point attached to the handle and having an exposed conical end having a taper between 20 and 40 degrees from a point centerline;

a spacer residing under the handle, the spacer having about ⅓ the diameter of the handle and a length of about 0.5 inches, the exposed conical end of the point extending from the spacer; and a compressible layer residing under the spacer, the point extending through the compressible layer;

grasping the handle of the puncturing tool;

pressing the point of the puncturing tool against a top surface of a lid of the vacuum sealed bottle with sufficient force to puncture the lid of the vacuum sealed bottle to release vacuum from the vacuum sealed bottle, wherein the point is filled, having no internal passageway between attachment of the point to the handle and a tip of the point opposite to the handle; and removing the lid from the vacuum sealed bottle.

2. The method of claim 1, wherein providing the puncturing tool comprises providing the point having the taper of about 30 degrees from the point centerline.

3. The method of claim 1, wherein providing the puncturing tool comprises the exposed conical end of the point extending between 3/16 inches and 1/16 inches from the spacer.

4. The method of claim 3, wherein providing the puncturing tool comprises the tip of the exposed conical end of the point extending about 3/16 inches from the spacer.

5. The method of claim 4, wherein providing the puncturing tool comprises:

the point having a cylindrical portion the exposed about 1/16 inches below the spacer; and the conical end of the point extending about ⅛ inches below the cylindrical portion.

6. The method of claim 5, wherein providing the puncturing tool comprises the point having a diameter about 0.15 inches.

7. The method of claim 4, wherein providing the puncturing tool comprises the compressible layer in an uncompressed state about ⅛ inches thick and the point extending about 1/16 inches below the compressible layer.

8. The method of claim 4, wherein providing the puncturing tool comprises the handle and spacer being made from plastic and the point is made from metal.

9. The method of claim 8, wherein providing the puncturing tool comprises the point is press fit into a hole in the spacer or the point threadably engaging the spacer.

10. The method of claim 1, wherein the point extends less than ⅛ inch from the bottom end of the handle.

11. The method of claim 10, wherein the point extends less than 1/16 inch from the bottom end of the handle.

12. The method of claim 1, further including:

covering the puncture in the lid; and placing the sealed bottle in a refrigerator.

13. The method of claim 1, wherein the point is fixedly attached by adhesive to the handle or by injection molded around the point.

14. The method of claim 1, wherein the point is fixedly attached by an interference fit into the handle.

15. A method for opening a vacuum sealed bottle, comprising:

providing a vacuum sealed bottle;

providing a lid puncturing tool comprising:

a handle having a diameter of about 1.5 inches and a height of about 0.6 inches;

a point attached to the handle and having an exposed conical end having a taper between 20 and 40 degrees from a point centerline;

a spacer residing under the handle, the spacer having about ⅓ the diameter of the handle and a length of about 0.5 inches, the exposed conical end of the point extending from the spacer; and a compressible layer residing under the spacer, the point extending through the compressible layer;

wherein the point is filled, having no internal passageway between attachment of the point to the handle and a tip of the point opposite to the handle, grasping the handle of the lid puncturing tool;

holding the tool to position the point extending down from the tool against a top surface of a lid of the vacuum sealed bottle;

pressing the point against the lid with sufficient force to puncture the lid;

releasing vacuum from the bottle;

removing the lid from the bottle;

removing at least some contents from the bottle;

replacing the lid onto the bottle; and placing adhesive tape over the puncture in the lid.

16. A method for opening a vacuum sealed bottle, comprising:

providing a vacuum sealed bottle having a metal lid;

providing a lid puncturing tool comprising:

a handle having a diameter of about 1.5 inches and a height of about 0.6 inches;

a spacer residing under the handle, the spacer having about ⅓ the diameter of the handle and a height of about 0.5 inches;

a point extending about 3/16 inches under the spacer and having a diameter of about 0.15 inches and an exposed conical end having a taper about 30 degrees from a point centerline; and a compressible layer residing under the spacer, the point extending through the compressible layer;

grasping the handle of the lid puncturing tool;

holding the tool to position the point against the lid of the vacuum sealed bottle;

pressing the point against the lid with sufficient force to puncture the lid;

releasing vacuum from the bottle, and removing the lid from the bottle.

17. The method of claim 16, wherein the point is filled, having no internal passageway between attachment of the point to the handle and a tip of the point opposite to the handle.

* * * * *